US008573715B1

(12) United States Patent
Jackman et al.

(10) Patent No.: US 8,573,715 B1
(45) Date of Patent: Nov. 5, 2013

(54) DUAL HINGED DISPENSER CABINET

(75) Inventors: Andrew Jackman, Langley (CA); Alex Trampolski, Richmond (CA); Steven M. Slye, Harrodsburg, KY (US)

(73) Assignee: Dispensing Dynamics International, City of Industry, CA (US)

( * ) Notice: Subject to any disclaimer, the term of this patent is extended or adjusted under 35 U.S.C. 154(b) by 406 days.

(21) Appl. No.: 12/928,516

(22) Filed: Dec. 13, 2010

(51) Int. Cl.
*B65H 49/00* (2006.01)

(52) U.S. Cl.
USPC ..... 312/34.4; 312/324; 220/4.22; 49/382; 49/193

(58) Field of Classification Search
USPC ..... 312/34.4, 324, 326, 329; 16/229–231, 16/265, 266, 268, 271, 272; 49/394, 397, 49/382, 192, 193; 220/4.21, 4.22, 843, 220/845, 847, 848
See application file for complete search history.

(56) References Cited

U.S. PATENT DOCUMENTS

| | | | | |
|---|---|---|---|---|
| 2,243,065 | A * | 5/1941 | Barrett | 220/845 |
| 3,516,115 | A * | 6/1970 | Koleske | 16/225 |
| 3,654,663 | A * | 4/1972 | Algotsson | 16/230 |
| 4,850,209 | A * | 7/1989 | Weinerman et al. | 70/208 |
| 5,065,878 | A * | 11/1991 | Altmann et al. | 220/3.8 |
| 5,342,122 | A * | 8/1994 | Gordon | 312/9.48 |
| 5,381,920 | A * | 1/1995 | Lin | 220/843 |
| 5,451,102 | A * | 9/1995 | Chuan | 312/263 |
| 6,000,769 | A * | 12/1999 | Chen | 312/223.2 |
| 6,098,836 | A | 8/2000 | Gottselig | |
| 6,806,944 | B2 * | 10/2004 | Votipka et al. | 355/75 |
| 6,929,147 | B2 | 8/2005 | Guillemette et al. | |
| 7,304,238 | B1 * | 12/2007 | Shotey et al. | 174/67 |
| 7,518,863 | B2 * | 4/2009 | Wayman et al. | 361/690 |
| 7,552,981 | B1 * | 6/2009 | Tuniewicz et al. | 312/324 |
| 2007/0079676 | A1 * | 4/2007 | Friesen et al. | 83/37 |
| 2007/0220708 | A1 * | 9/2007 | Lewis | 16/334 |
| 2009/0066201 | A1 | 3/2009 | Colon et al. | |

* cited by examiner

*Primary Examiner* — Janet M Wilkins
*Assistant Examiner* — Daniel Rohrhoff
(74) *Attorney, Agent, or Firm* — Thomas R. Lampe

(57) ABSTRACT

A dispenser cabinet for holding and dispensing paper toweling or other paper sheet material includes a front dispenser cabinet portion and a rear dispenser cabinet portion. Hinge receptacles are attached to both left and right side walls of the dispenser cabinet portions and hinges are selectively alternatively positionable in the hinge receptacles to allow the hinge connection between the dispenser cabinet portions to be changed between left and right side walls.

5 Claims, 5 Drawing Sheets

DUAL HINGED DISPENSER CABINET

TECHNICAL FIELD

This invention relates to a dispenser cabinet or housing for holding and dispensing paper toweling or other paper sheet material. The dispenser cabinet includes dual hinge structure allowing the cabinet to be adapted for opening from either the left hand side or the right hand side.

BACKGROUND OF THE INVENTION

It is of course well known to provide a hinged interconnection between a front dispenser cabinet portion or cover and a rear dispenser cabinet portion, the latter being attachable to walls or other vertical supports.

It is also known generally to provide a pivotal interconnection between the dispenser cabinet portions at either the left hand side or right hand side thereof. Conventionally this hinge arrangement is permanent, typically being installed during manufacture.

At the location of installation of these prior art dispenser cabinets it may be found that the left or right hand hinging is inappropriate if certain building features exist. For example, a room corner may be the desired location of installation and the dispenser cabinet must be properly hinged, either right or left, to enable the dispenser cabinet to be properly opened for replenishment of the contents or for other reasons.

A patentability search directed to this invention located the following prior art: U.S. Pat. No. 6,098,836, issued Aug. 8, 2000, U.S. Patent App. Pub. No. US 2009/0066201, published Mar. 12, 2009, U.S. Pat. No. 6,929,147, issued Aug. 16, 2005.

DISCLOSURE OF INVENTION

The dispenser cabinet for holding and dispensing paper toweling or other paper sheet material of the present invention incorporates a novel dual hinge system which may readily be configured for left or right hand opening after it leaves the plant. The configuration can readily be changed in the field by reversing the hinging installed at the plant. This dual opening capability gives the user the option of mounting the dispenser cabinet on either side of building features.

The dispenser cabinet of this invention is for holding and dispensing paper toweling or other paper sheet material. The cabinet includes a front dispenser cabinet portion having spaced left and right side walls, a top and a bottom. The top and bottom of the front dispenser cabinet portion extend between the left and right side walls thereof.

The dispenser cabinet also incorporates a rear dispenser cabinet portion having spaced left and right side walls, a top and a bottom, the top and bottom of the rear dispenser cabinet portion extending between the left and right side walls thereof.

The front and rear dispenser cabinet portions are relatively moveable between a closed configuration wherein the front and rear dispenser cabinet portions jointly form a closed dispenser cabinet interior and an open configuration wherein the front and rear dispenser cabinet portions do not form a closed dispenser cabinet interior.

Hinge receptacles are attached to the left and right side walls of the front dispenser cabinet portion and to the left and right side walls of the rear dispenser cabinet portion.

Hinges are selectively alternatively positionable in the hinge receptacles attached to different side walls of the front and rear dispenser cabinet portions whereby a pivotal interconnection between the front and rear dispenser cabinet portions may be alternatively established either between the left side walls thereof or the right side walls thereof to allow relative movement therebetween.

Other features, advantages and objects of the present invention will become apparent with reference to the following description and accompanying drawings.

MODES FOR CARRYING OUT THE INVENTION

Figure 1:
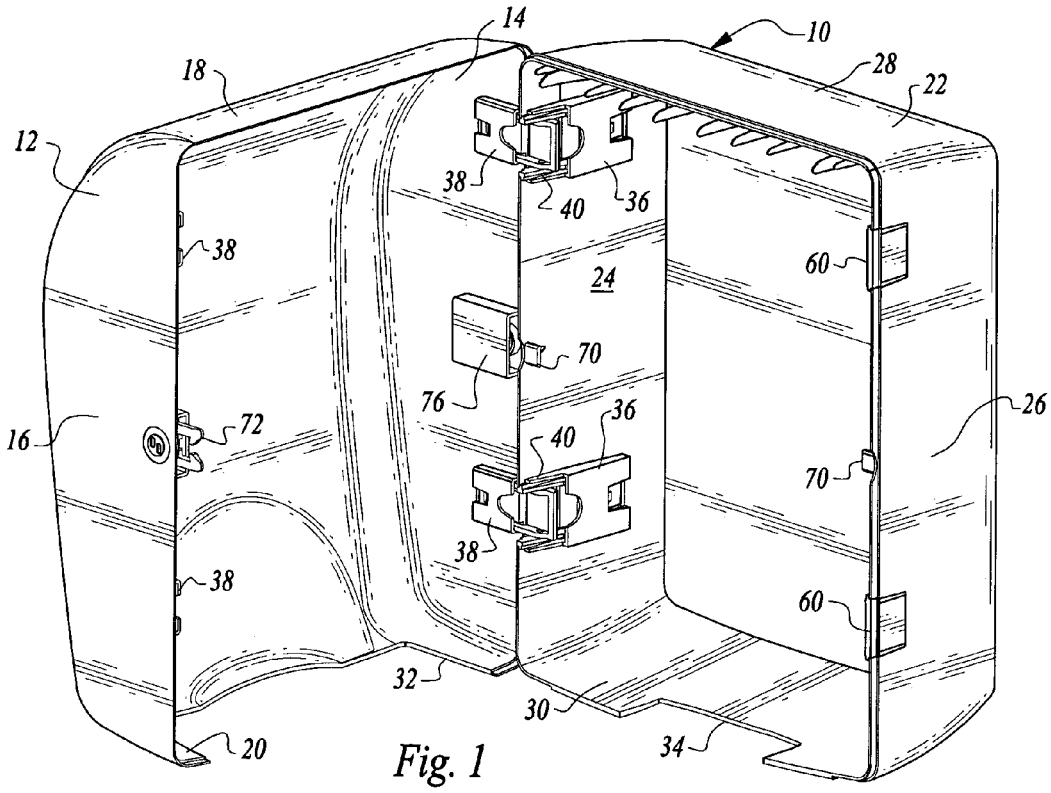
FIG. 1 is a perspective view of a dispenser cabinet constructed in accordance with the teachings of the present invention illustrating front and rear dispenser cabinet portions in an open configuration and pivotally interconnected by hinges at the left side walls thereof.

Referring now to the drawings, a dispenser cabinet constructed in accordance with the teachings of the present invention is illustrated, the cabinet being designated by reference numeral 10. The dispenser cabinet is for holding and dispensing paper toweling or other paper sheet material.

There are of course many mechanisms and modes of operation utilized when dispensing paper toweling or other paper sheet material from a dispenser cabinet or housing. The dispenser cabinet of this invention may be utilized with many suitable and known dispensing mechanisms or approaches. Since the invention relates to the dispenser cabinet per se, no illustration of structural elements actually employed to cause dispensing from the dispenser cabinet is illustrated, nor is it considered necessary to illustrate paper toweling or other paper sheet material.

The dispenser cabinet 10 includes a front dispenser cabinet portion or cover 12 having (as viewed from in front of the cabinet) a left side wall 14, a right side wall 16 spaced from the left side wall, a top 18 and a bottom 20. The top and bottom extend between the left and right side walls 14, 16.

The dispenser cabinet also includes a rear dispenser cabinet portion 22 having spaced left and right side walls 24, 26, a top 28 and a bottom 30 extending between the left and right side walls 24, 26.

Figure 2:
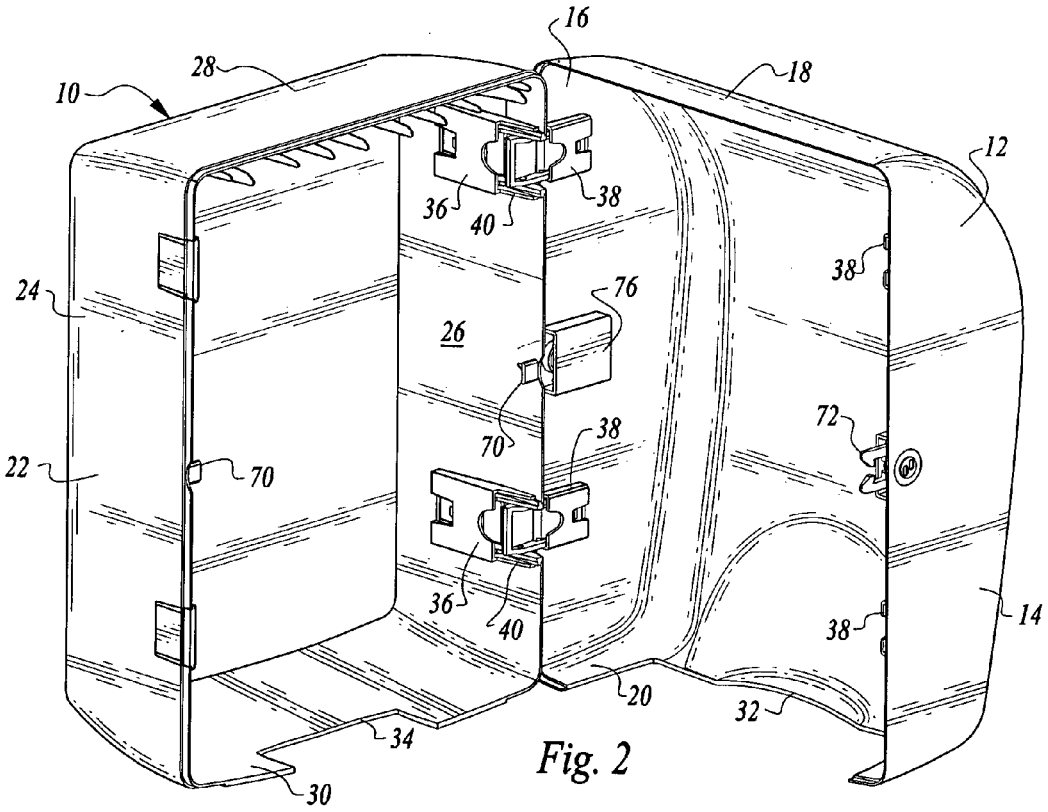
FIG. 2 is a view similar to FIG. 1, but illustrating the dispenser cabinet portions hinged at the right side walls thereof.
Figure 3:
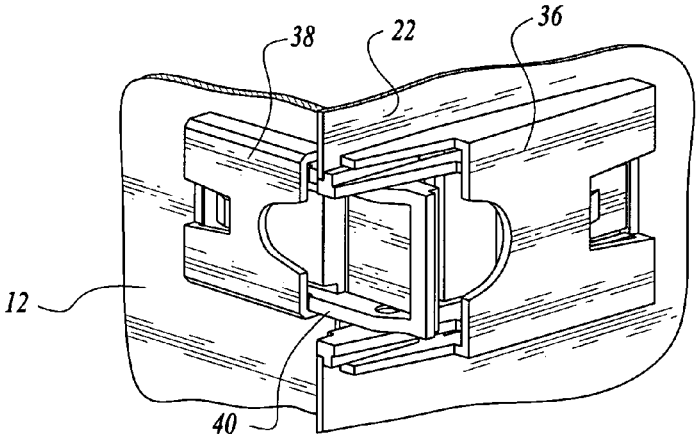
FIG. 3 is an enlarged, perspective view illustrating hinge receptacles and a hinge of the dispenser cabinet in the configuration illustrated in FIG. 1.

The front and rear dispenser cabinet portions are relatively moveable between a closed configuration wherein the front and rear dispenser cabinet portions jointly form a closed dispenser cabinet interior and an open configuration wherein the front and rear dispenser cabinet portions do not form a closed dispenser cabinet interior. FIGS. 1 and 2 illustrate the dispenser cabinet portions in the open configuration.

It will also be seen in such figures that the bottom 20 defines an opening 32 and bottom 30 defines an opening 34. This is simply to illustrate an opening arrangement of one possible type allowing for the egress of paper toweling therethrough, dispenser cabinet 10 being configured for such purpose. It will be appreciated, however, that dispensing openings may be elsewhere in the cabinet and that openings 32 and 34 are for illustrative purposes only.

FIG. 1 illustrates the use of hinges at the left side walls of the front and rear dispenser cabinet portions. FIG. 2, on the other hand, shows the dispenser cabinet portions being hinged at the right side walls thereof. With the disclosed structure the hinges may be readily moved to provide either right hand or left hand opening.

Hinge receptacles are attached to the left and right side walls of the front dispenser cabinet portion or cover and to the left and right side walls of the rear dispenser cabinet portion. The hinge receptacles attached to the rear dispenser cabinet portion are identified by reference numeral 36 and the receptacles attached to the front dispenser cabinet portion are identified by reference numeral 38. In the arrangement illustrated, there are four receptacles per dispenser cabinet portion, two on each side.

Hinges 40 are selectively alternatively positionable in the hinge receptacles attached to different side walls of the front and rear dispenser cabinet portions whereby a pivotal interconnection between the front and rear dispenser cabinet portions may be alternatively established either between the left side walls thereof, as shown in FIG. 1, or the right side walls thereof, as shown in FIG. 2, to allow relative movement therebetween. In most installations, the rear dispensing cabinet portion 22 is secured to a wall or other support and does not move, while the front dispenser cabinet portion functions as a cover that swings between an open and closed position in the normal manner.

Figure 19:
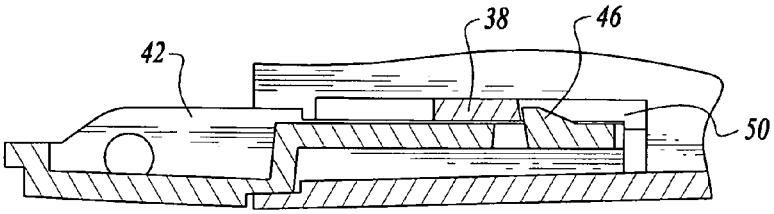
FIG. 19 is a greatly enlarged, cross-sectional view taken along the line 19-19 of FIG. 7, but illustrating the hinge element latched in place in a hinge receptacle.
Figure 20:
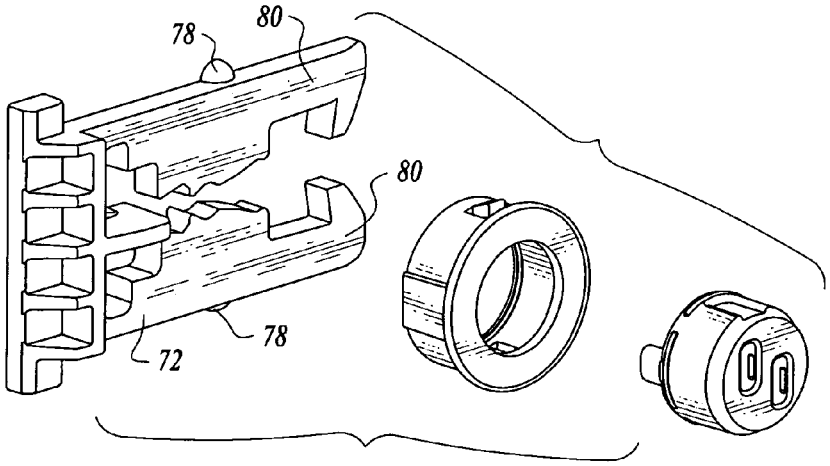
FIG. 20 is an exploded, perspective view illustrating structural components of the lock mechanism.

Each of the hinges 40 includes two pivotally interconnected hinge elements, hinge element 42 and hinge element 44. Each of the hinge elements includes a connector member. With respect to hinge element 42, the hinge element is in the form of a flexible detent 46. In the case of hinge element 44, the connector member is in the form of a flexible detent 48. Hinge element 42 is received by a receptacle 38 to secure the hinge to the front dispenser cabinet portion, the detent 48 entering into opening 50 in hinge receptacle 38. This is shown in detail in cross-sectional view in FIG. 19.

Figure 18:
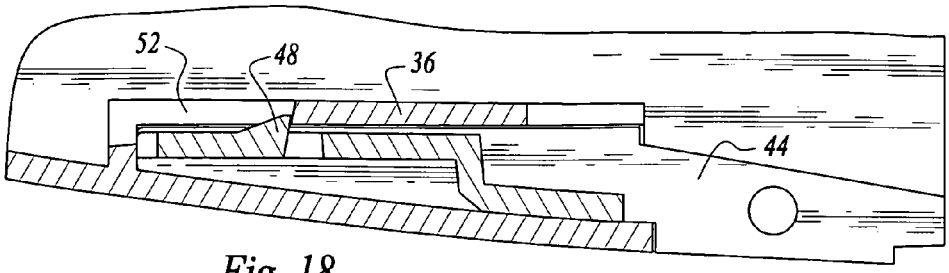
FIG. 18 is a greatly enlarged, cross-sectional view taken along the line 18-18 of FIG. 4, but illustrating the hinge element latched in place in a hinge receptacle.

Hinge element 44, on the other hand, enters a hinge receptacle 36 of the rear dispenser cabinet portion 32. When in place, the detent 48 of hinge element 44 will snap in place into an opening 52 in rear hinge receptacle 36. This is shown, for example, in FIG. 18. The hinge elements may be removed from their respective receptacles by simply manually manipulating the detents thereof to move the detents out of their respective openings while pulling on the hinge elements.

The above-described arrangement allows for ready conversion of the dispenser cabinet from right opening to left opening and vice versa. The hinge elements are substantially symmetrical along the longitudinal axes thereof. This enables the hinge elements to be moved between hinge receptacles of the left and right side walls upon 180 degree rotation of the hinge elements.

Figure 4:
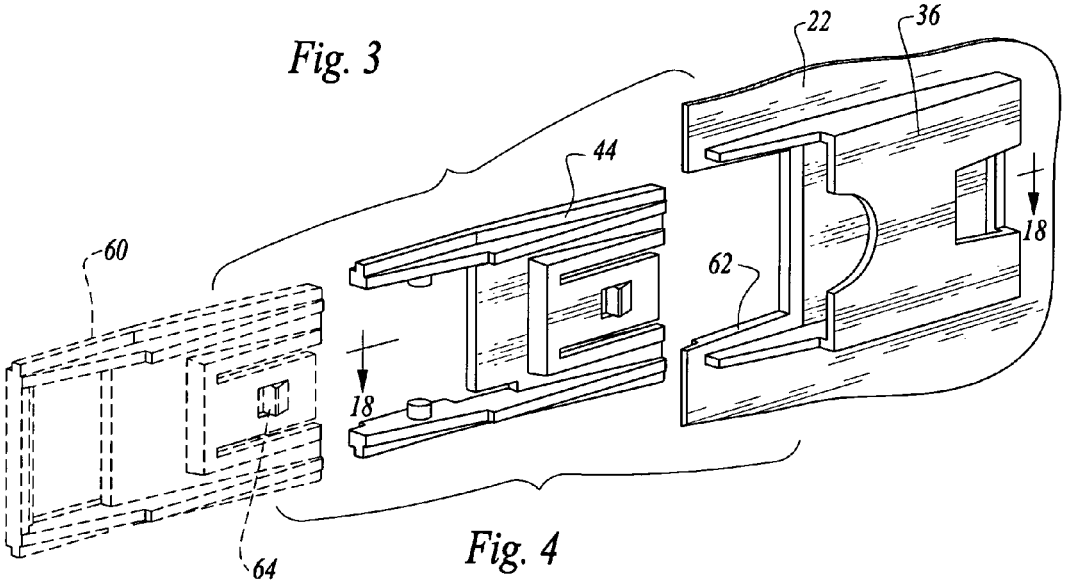
FIG. 4 is an exploded, perspective view illustrating the hinge receptacle shown in FIG. 3 and a hinge element (shown in solid lines) prior to entry into the hinge receptacle, an alternative plug for entering the receptacle when it does not accommodate a hinge element being shown in dash lines.
Figure 5:
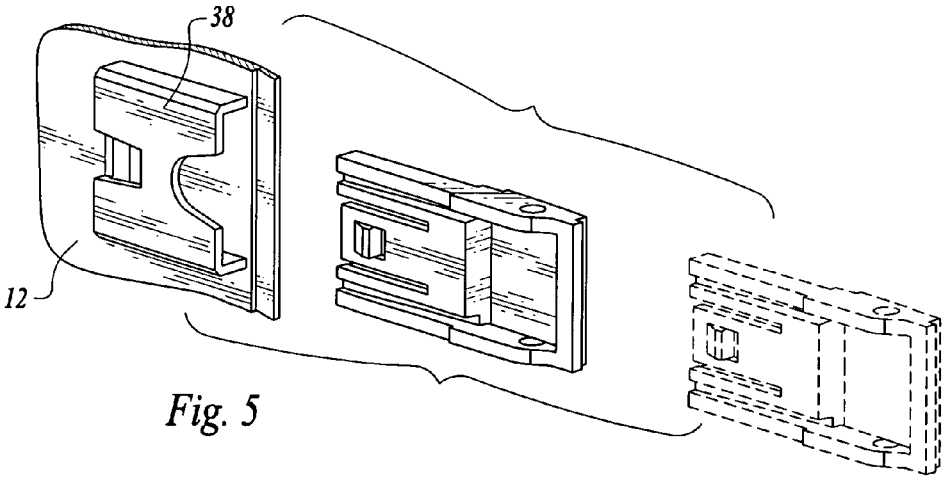
FIG. 5 is an enlarged, exploded view illustrating a hinge receptacle attached to an inner surface portion of the left side wall as shown in FIG. 1 preparatory to a hinge element entering the hinge receptacle.
Figure 6:
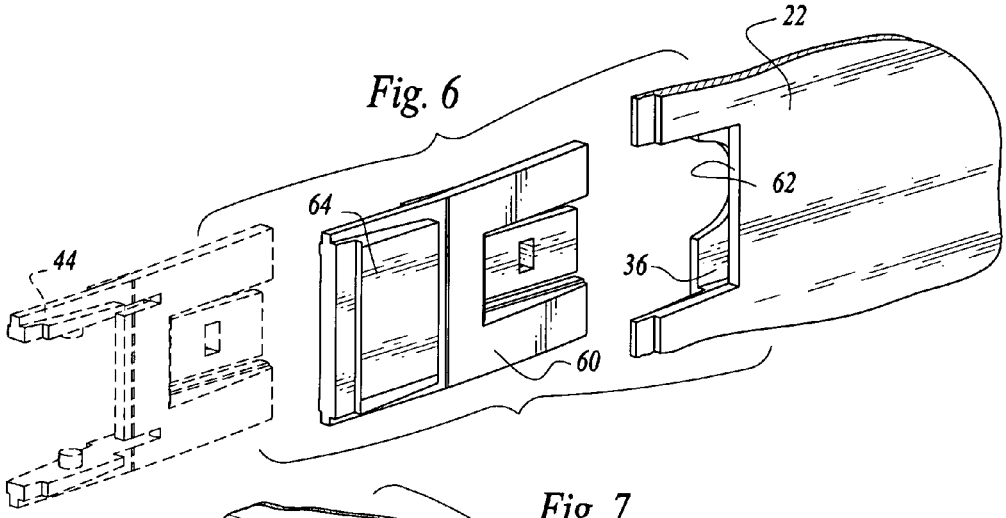
FIG. 6 is an exploded, perspective view illustrating a plug prior to entry into a hinge receptacle at a rear dispenser portion right side wall, a hinge element that may be alternatively be accommodated by the hinge receptacle being shown in dash lines.
Figure 7:
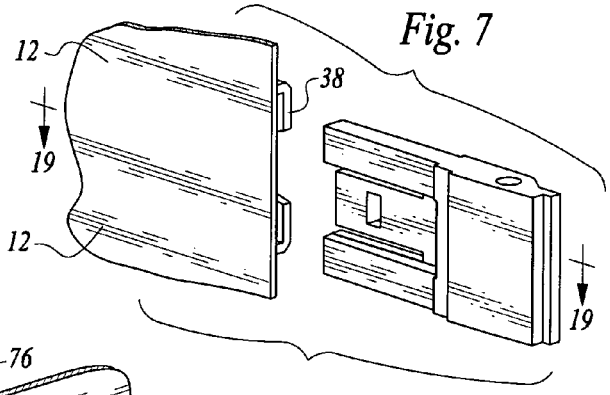
FIG. 7 is an exploded, perspective view illustrating a hinge element prior to entry into a hinge receptacle at the left side wall of the front dispenser cabinet portion.
Figure 8:
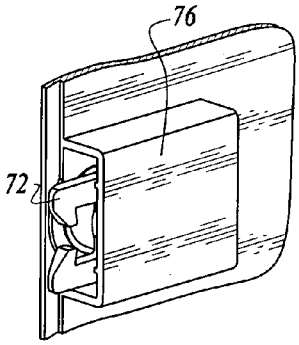
FIG. 8 is an enlarged, perspective view illustrating a lock mechanism and lock mechanism housing of the invention attached to the inner surface of a side wall of the front dispenser cabinet portion or cover of the dispenser cabinet.

Another feature of the invention is the use of plug members for positioning in hinge receptacles not accommodating the hinges to modify the external appearance of the dispenser cabinet by filling in voids in side walls otherwise filled in by hinge elements. In particular, removal of a hinge element 44 from a hinge receptacle 36 will create a void in the side wall thereof in the vicinity of the hinge receptacle 36. To provide a more attractive appearance and cover the void, a plug 60 is employed. FIG. 6 shows in solid lines a plug 60 prior to its insertion into hinge receptacle 36 to fill a void 62 created by removal of hinge element 44, the latter being depicted by dash lines. A detent arrangement similar to that employed on the hinge element 44 is utilized on the plug for the purpose of releasably retaining the plug in place. A projection 64 (FIG. 4) on the plug matches the shape and size of the void 62.

It will be appreciated that shifting of the hinge structure from left hand to right hand and vice versa affects structure relating to locking of the front dispenser cabinet portion or cover to the rear dispenser cabinet portion. The dispenser cabinet 10 incorporates structure to deal with this matter. In the cabinet the lock should be effective at the free or non-hinged end of the cover. Structure has been provided to readily make this conversion.

Lock elements 70 are fixedly attached to each of the rear dispenser cabinet portion 22 left and right side walls. A lock mechanism 72 is selectively alternatively positionable on and connectable to either of the left and right side walls of the front dispenser cabinet portion. The lock mechanism 72 may be of any suitable known type, one of which is illustrated in the drawings. The lock mechanism 72 is cooperable with the lock element 70 attached to the rear dispenser cabinet portion right side wall when the front and rear dispenser cabinet portions are pivotally connected at the left side walls thereof and cooperable with the lock element 70 attached to the rear dispenser cabinet portion left side wall when the front and rear dispenser cabinet portions are pivotally connected at the right side walls thereof.

Figure 9:
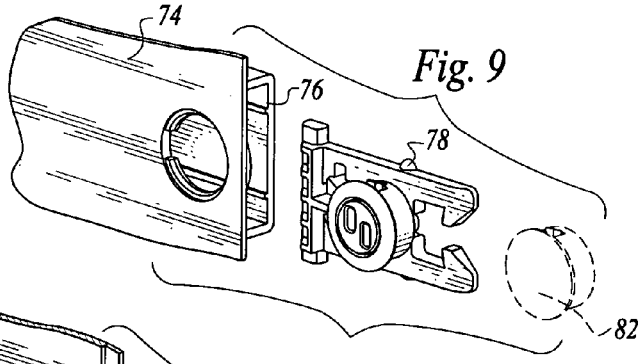
FIG. 9 is an exploded view illustrating the lock mechanism prior to entry into the housing associated with the front dispenser cabinet portion along with a plug (shown in dash lines) that alternatively may be positioned in the housing.
Figure 10:
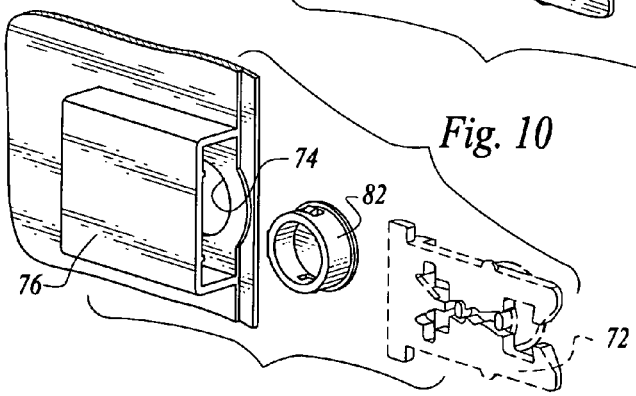
FIG. 10 is a perspective view illustrating the housing and plug from an opposed side, the plug in this instance being illustrated by solid lines and the lock mechanism shown in dash lines.
Figure 11:
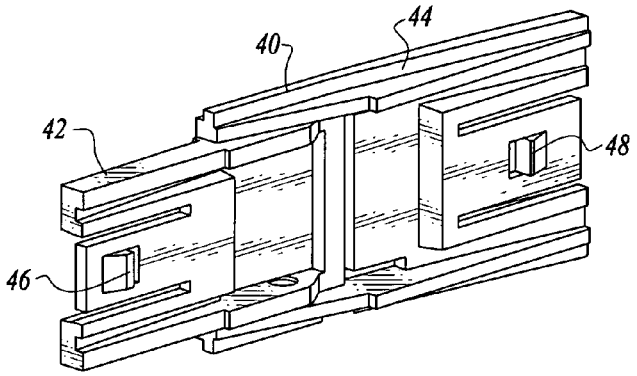
FIG. 11 is a perspective, side view of a hinge, the hinge incorporating two pivotally interconnected hinge elements.
Figure 12:
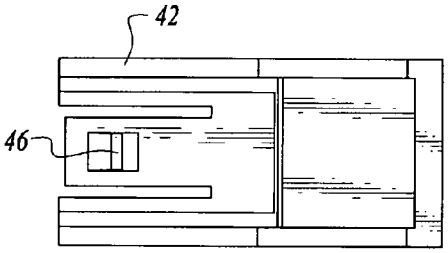
FIG. 12 is a side, elevational view of one of the hinge elements of the hinge of FIG. 11.
Figure 15:
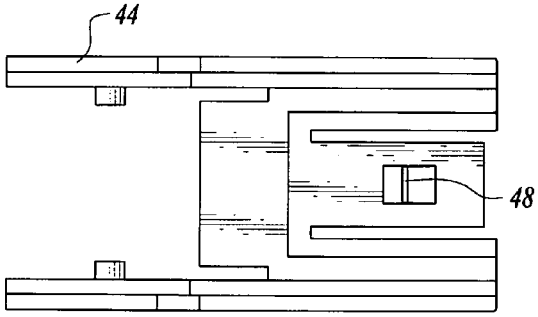
FIG. 15 is a side, elevational view of another hinge element of the hinge of FIG. 11.
Figure 13:
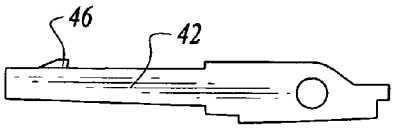
FIG. 13 is a top, plan view of the hinge element of FIG. 12.
Figure 16:
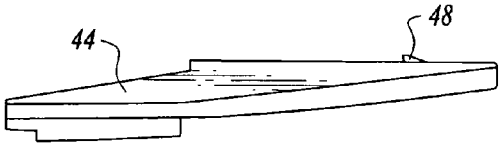
FIG. 16 is a top, plan view of the hinge element of FIG. 15.
Figure 14:
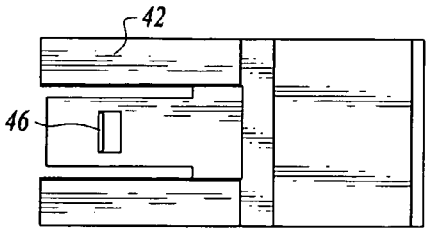
FIG. 14 is an elevational view of the hinge element of FIGS. 12 and 13 as viewed from a side opposite that illustrated in FIG. 12.
Figure 17:
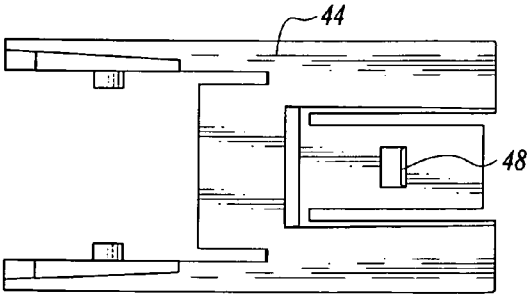
FIG. 17 is an elevational view of the hinge element shown in FIGS. 15 and 16 as seen from a side thereof opposite that illustrated in FIG. 15.
Figure 21:
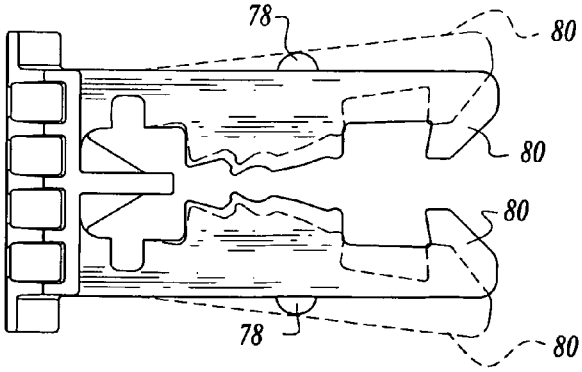
FIG. 21 is a side, elevational view illustrating alternative positions of lock mechanism latch members in locking and unlocked positions (shown respectively in solid and dash lines)
Figure 22:
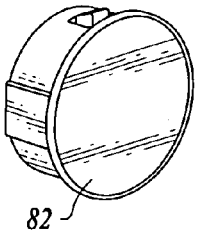
FIG. 22 is an enlarged, perspective view of a plug utilized to fill in an opening in the front dispenser cabinet portion not occupied by the lock mechanism.

Lock mechanism 72 extends into a selected one of two holes formed in opposite side walls of the front dispenser cabinet portion. FIGS. 9 and 10 illustrate a hole 74 in one of the front dispenser cabinet portion side walls. FIG. 9 illustrates the lock mechanism 72 prior to placement thereof in a housing 76 opposed to hole 60. Any suitable expedient such as detents 78 may be utilized to maintain the lock mechanism 72 in place within the housing and accessible by a key (not shown) to move the latch ends 80 thereof which engage the associated lock element 70 in either locking or non-locking position as shown in FIG. 21.

The lock mechanism 72 may readily be transferred to the other side wall of the cover if desired. A plug 82 may be used to cover the unsightly hole 74 after the lock mechanism 72 has been removed. FIG. 10 illustrates in dash lines a removed lock mechanism 72. The plug 82 is illustrated in solid lines prepratory to being positioned in hole 74. A releasable detent or other suitable means may be employed to maintain the plug in position. The housings 76 provide protection for the lock mechanism when placed therein.

The invention claimed is:

1. A dispenser cabinet for holding and dispensing paper toweling or other paper sheet material, said dispenser cabinet including, in combination:

a front dispenser cabinet portion having spaced left and right side walls, a top and a bottom, said top and bottom of said front dispenser cabinet portion extending between the left and right side walls thereof;

a rear dispenser cabinet portion having spaced left and right side walls, a top and a bottom, said top and bottom of said rear dispenser cabinet portion extending between the left and right side walls thereof, the front and rear dispenser cabinet portions relatively movable between a closed configuration wherein the front and rear dispenser cabinet portions jointly form a closed dispenser cabinet interior and an open configuration wherein the front and rear dispenser cabinet portions do not form a closed dispenser cabinet interior;

hinge receptacles attached to each of the left and right side walls of the front dispenser cabinet portion and to the left and right side walls of the rear dispenser cabinet portion, each hinge receptacle defining a receptacle interior; and hinges selectively alternatively positionable in the hinge receptacle interiors of the hinge receptacles attached to different side walls of the front and rear dispenser cabinet portions whereby a pivotal interconnection between said front and rear dispenser cabinet portions may be alternatively established either between the left side walls thereof or the right side walls thereof to allow relative pivotal movement therebetween, each of said hinges being elongated, having a longitudinal axis and including first and second pivotally interconnected hinge elements, each of said hinge elements including a connector member, the connector member of said first hinge element comprising a flexible detent releasably engageable with a hinge receptacle on said front dispenser cabinet portion and positionable in an opening defined by the hinge receptacle on said front dispenser cabinet portion to releasably secure the hinge to said front dispenser cabinet portion when said first hinge element is located in the receptacle interior of the hinge receptacle on said front dispenser cabinet portion, and the connector member of the second hinge element comprising a flexible detent releasably engageable with a hinge receptacle on said rear dispenser cabinet portion and positionable in an opening defined by the hinge receptacle on the rear dispenser cabinet portion to releasably secure the hinge to said rear dispenser cabinet portion when said second hinge element is located in the receptacle interior of the hinge receptacle on said rear dispenser cabinet portion, said hinge elements of each hinge substantially symmetrical along the longitudinal axis of the hinge, enabling said hinge elements to be moved between hinge receptacles of the left and right side walls upon 180 degree rotation of the hinge about said longitudinal axis and installed on either said left side walls or said right side walls.

2. The dispenser cabinet according to claim 1 additionally comprising plug members for positioning in hinge receptacles not accommodating said hinges to modify the external appearance of said dispenser cabinet by filling in voids in side walls otherwise filled in by hinges.

3. The dispenser cabinet according to claim 1 additionally including a lock element fixedly attached to each of said back dispenser portion left and right side walls and a lock mechanism selectively alternatively positionable on and connectable to either of the left and right side walls of said front dispenser cabinet portion, said lock mechanism cooperable with the lock element attached to said back dispenser portion right side wall when the front and rear dispenser cabinet portions are pivotally connected at the left side walls thereof and cooperable with the lock element attached to said back dispenser portion left side wall when the front and rear dispenser cabinet portions are pivotally connected at the right side walls thereof.

4. The dispenser cabinet according to claim 3 wherein said lock mechanism extends through a selected one of two holes formed in the front dispenser cabinet portion for alternatively accommodating said lock mechanism, said dispenser cabinet additionally including a plug for filling the hole not accommodating said lock mechanism.

5. The dispenser cabinet according to claim 4 additionally including housings connected to the interior surfaces of the left and right side walls of the front dispenser cabinet portion for protecting the lock mechanism.

* * * * *